US008674854B2

(12) United States Patent
Lee et al.

(10) Patent No.: US 8,674,854 B2
(45) Date of Patent: Mar. 18, 2014

(54) TRAFFIC CONTROL APPARATUS AND METHOD USING NAVIGATION ROUTE INFORMATION OF VEHICLE FOR EACH NAVIGATIONAL SITUATION

(75) Inventors: Byung-Gil Lee, Daejeon (KR); Jong-Wook Han, Daejeon (KR); Hyun-Sook Cho, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 223 days.

(21) Appl. No.: 13/030,328

(22) Filed: Feb. 18, 2011

(65) Prior Publication Data

US 2011/0210865 A1 Sep. 1, 2011

(30) Foreign Application Priority Data

Feb. 26, 2010 (KR) ..... 10-2010-0018106

(51) Int. Cl.
*G08G 1/123* (2006.01)

(52) U.S. Cl.
USPC ..... 340/995.19; 340/961; 340/984; 701/410; 701/411; 701/415; 701/416; 701/301

(58) Field of Classification Search
USPC ..... 340/961, 903, 995.19, 984; 701/301, 701/120, 410, 411, 415, 416, 431; 342/29, 342/30
See application file for complete search history.

(56) References Cited

U.S. PATENT DOCUMENTS

| | | | | |
|---|---|---|---|---|
| 4,086,632 | A * | 4/1978 | Lions | 701/418 |
| 4,642,775 | A * | 2/1987 | Cline et al. | 701/528 |
| 8,090,525 | B2 * | 1/2012 | Villiers | 701/120 |
| 2006/0256000 | A1 * | 11/2006 | Larsson et al. | 342/30 |
| 2006/0265294 | A1 * | 11/2006 | de Sylva | 705/28 |
| 2008/0249669 | A1 * | 10/2008 | Skarman | 701/3 |

FOREIGN PATENT DOCUMENTS

| | | | |
|---|---|---|---|
| JP | 2005-300388 | A | 10/2005 |
| KR | 1020000009706 | A | 2/2000 |
| KR | 1020020034143 | A | 5/2002 |
| KR | 10-2007-0013701 | A | 1/2007 |
| KR | 10-2009-0036683 | | 4/2009 |

OTHER PUBLICATIONS

Tae-Woo Kwon et al., "A coast traffic control system using IP-RFID technology", Proceedings of the Korean Institute of Navigation and Port Research Conference, 2009, pp. 17-18.

* cited by examiner

*Primary Examiner* — Brent Swarthout

(57) ABSTRACT

Disclosed herein is a traffic control apparatus and method. The traffic control apparatus includes a navigation route database (DB) for storing navigation routes of a vehicle for respective navigational situations. A vehicle situation information collection unit collects current navigational situation information of the vehicle. A preferred route extraction unit extracts a preferred navigation route of the vehicle corresponding to the collected current navigational situation information from the navigation route DB. A predicted route estimation unit estimates a predicted navigation route of the vehicle based on the extracted preferred navigation route with reference to a traveling state of the vehicle.

16 Claims, 5 Drawing Sheets

TRAFFIC CONTROL APPARATUS AND METHOD USING NAVIGATION ROUTE INFORMATION OF VEHICLE FOR EACH NAVIGATIONAL SITUATION

CROSS REFERENCE TO RELATED APPLICATION

This application claims the benefit of Korean Patent Application No. 10-2010-0018106, filed on Feb. 26, 2010, which is hereby incorporated by reference in its entirety into this application.

BACKGROUND OF THE INVENTION

1. Technical Field

The present invention relates generally to a traffic control apparatus and method using navigation route information of a vehicle for each navigational situation and, more particularly, to a traffic control apparatus and method wherein, when estimating the predicted navigation route of a specific vehicle that is navigating, the navigation routes of the specific vehicle for respective navigational situations, which have been previously stored, are used.

2. Description of the Related Art

Most collisions between ships on the sea have been considered as being occurred due to the carelessness of ship navigators. Further, ship navigators who are responsible for navigation cannot always concentrate on navigation every hour, and have many difficulties when navigating ships while personally having to separately check and anticipate all the situations that may occur during a navigation procedure.

That is, in order to prevent collisions between ships which are navigating, a method by which a control center on the ground checks the movements of all ships, anticipates dangerous situations caused by the movements, and notifies relevant ships of the risk of a collision when there is a high probability that a collision will occur, is more effective than a method by which relevant ships determine whether a collision will occur and cope with such a determination.

Therefore, in current domestic/foreign principal ports, vessel traffic service systems have been installed and operated, and a control system for preventing collisions between ships caused by the navigation of the ships is provided.

However, in the prior art, a controller has performed traffic control in such a way as to intensely monitor a control screen on which the locations of relevant ships are displayed, check the distances between the ships or the like on the basis of his or her work experience, predict a probability that the ships will collide, and then control the navigation routes of relevant ships if it is determined that the probability of a collision is high.

Further, ships located adjacent to a relevant ship are identified using radar or the like mounted in the relevant ship, and the relevant ship takes into consideration the existence of the identified ships at the time of navigating.

Meanwhile, because of recent developments in maritime wireless communication technology, a ship can transmit ship information, including its identification information (for example, the name of the ship), to a control center using an Automatic Identification System (AIS). Accordingly, the control center can definitely determine which ship is located at a specific location on the sea. Generally, on the control screen of the control center, the current locations of ships or airplanes are displayed on a map, and the names of the ships or airplanes are simply displayed beside the current locations.

FIG. 1 is a diagram showing an example of network configuration of an Automatic Identification System (AIS) for merchant ships defined by the International Maritime Organization (IMO).

Referring to FIG. 1, AIS implemented in each ship 10 enables various types of information such as the current location, course, speed, and state of the ship measured by a Global Positioning System (GPS) and other types of information to be transmitted to a control center 30 through a relevant relay station 20 on the ground. In this case, the AIS transmits the navigational situation information of a relevant ship even to adjacent ships, thus enabling all ships navigating on the sea to ascertain mutual navigational states. Meanwhile, the control center 30 on the ground is connected to user terminals 40 over a network (for example, the Internet), and then can provide information about ships which are navigating on the sea to the user terminals 40.

However, such a conventional control scheme ascertains only the current location and name of a ship and does not provide a method of controlling ships based on the navigation routes of the ships. Therefore, there is no great difference between such a control scheme and control schemes that preceded it.

That is, a controller must still intensely monitor the control screen on which the locations of ships are displayed, and must predict the probability of the collisions between ships by checking the locations of ships, the mutual distances between the ships, etc. on the basis of his or her work experience.

However, since this control method is subjectively performed depending on the experience of the controller, the risk of causing accidents is always present, and the navigation routes of relevant ships are not taken into consideration, so that performing more precise control is accompanied by a lot of restrictions.

Further, since a controller must continuously intensely monitor maritime situations every hour, he or she feels more fatigue and is then easily susceptible to carelessness, with the passage of time.

Therefore, methods of allowing a controller to perform more precise control by estimating the predicted navigation routes of ships and by providing the predicted navigation routes to the controller are required. Further, there are required methods of automatically predicting a possible accident scenario, and of, when there is a probability that a collision between ships will occur, detecting the probability of the collision between the ships, and notifying the controller of the probability of the collision in advance, with the result that the collision between ships can be prevented.

SUMMARY OF THE INVENTION

Accordingly, the present invention has been made keeping in mind the above problems occurring in the prior art, and an object of the present invention is to provide a traffic control apparatus and method, which estimate the predicted navigation routes of ships, automatically predict a possible accident scenario using the estimated predicted navigation routes, and notify a controller of the probability of a collision in advance, thus preventing a collision between ships from occurring.

A traffic control apparatus according to the present invention includes a navigation route database (DB) for storing navigation routes of a vehicle for respective navigational situations; a vehicle situation information collection unit for collecting current navigational situation information of the vehicle; a preferred route extraction unit for extracting a preferred navigation route of the vehicle corresponding to the collected current navigational situation information from the navigation route DB; and a predicted route estimation unit for estimating a predicted navigation route of the vehicle based on the extracted preferred navigation route with reference to a traveling state of the vehicle.

Preferably, the traffic control apparatus may further include a collision risk analysis unit for comparing the predicted navigation route with a predicted navigation route of a vehicle adjacent to the vehicle, calculating a risk of a collision between the vehicle and the adjacent vehicle, and performing processing such that if the risk of the collision exceeds a threshold, information for warning the risk of the collision between the vehicles is output.

Preferably, the navigational situation information may include identification information, navigator information, and location information of the vehicle, meteorological condition information about a place where the vehicle is located, and starting point and destination information of the vehicle.

Preferably, the meteorological condition information may include information about one or more of weather, wind direction, wind velocity, wave height, and rainfall of the place where the vehicle is located.

Preferably, the traffic control apparatus may further include a communication unit for receiving information for warning the risk of a collision between the vehicles from the collision risk analysis unit and transmitting the received information to relevant vehicles.

Preferably, the traffic control apparatus may further include a current information analysis unit for storing navigation routes of the vehicle for respective navigational situations in the navigation route DB, based on the current navigational situation information collected by the vehicle situation information collection unit.

Preferably, the traffic control apparatus may further include a decision-making supporting unit for receiving information for warning a risk of a collision between the vehicles from the collision risk analysis unit so as to support decision-making of a controller who is controlling the vehicle, and auditorily or visually outputting the received information.

Preferably, the preferred route extraction unit may analyze a degree of correlation between the current navigational situation information of the vehicle and the navigation routes for respective navigational situations stored in the navigation route DB, and extract the preferred navigation route from the navigation route DB based on results of the analysis.

Preferably, the vehicle may be either a ship or an airplane.

Preferably, the vehicle information collection unit may collect the navigational situation information using an Automatic Identification System (AIS) provided on the ship when the vehicle is the ship.

A traffic control method according to the present invention includes collecting current navigational situation information of a vehicle that is navigating; extracting a preferred navigation route of the vehicle corresponding to the collected current navigational situation information from a navigation route database (DB) which stores navigation routes of the vehicle for respective navigational situations; and estimating a predicted navigation route of the vehicle based on the extracted preferred navigation route with reference to a traveling state of the vehicle.

Preferably, the traffic control method may further include comparing the predicted navigation route with a predicted navigation route of a vehicle adjacent to the vehicle, and calculating a risk of a collision between the vehicle and the adjacent vehicle; determining whether the risk of the collision exceeds a threshold; and if it is determined that the risk of the collision exceeds the threshold, performing processing such that information for warning the risk of the collision between the vehicles is output.

Preferably, the performing processing such that information for warning the risk of the collision between the vehicles is output may be configured such that the information for warning the risk of the collision between the vehicles is auditorily or visually output so as to support decision-making of a controller who is controlling the vehicle.

Preferably, the navigational situation information may include identification information, navigator information, and location information of the vehicle, meteorological condition information about a place where the vehicle is located, and starting point and destination information of the vehicle.

Preferably, the meteorological condition information may include information about one or more of weather, wind direction, wind velocity, wave height, and rainfall of the place where the vehicle is located.

Preferably, the traffic control method may further include transmitting information for warning the risk of the collision between the vehicles to the relevant vehicles.

Preferably, the traffic control method may further include storing the navigation routes of the vehicle for respective navigational situations in the navigation route DB based on the collected current navigational situation information.

Preferably, the extracting the preferred navigation route of the vehicle corresponding to the collected current navigational situation information from the DB may include analyzing a degree of correlation between the current navigational situation information of the vehicle and the navigation routes for respective navigational situations stored in the navigation route DB; and extracting the preferred navigation route from the navigation route DB based on results of the analysis.

Preferably, the vehicle may be either a ship or an airplane.

Preferably, when the vehicle may be the ship, the collecting the current navigational situation information of the vehicle that is navigating may be configured such that the navigational situation information is collected using an Automatic Identification System (AIS) provided on the ship.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
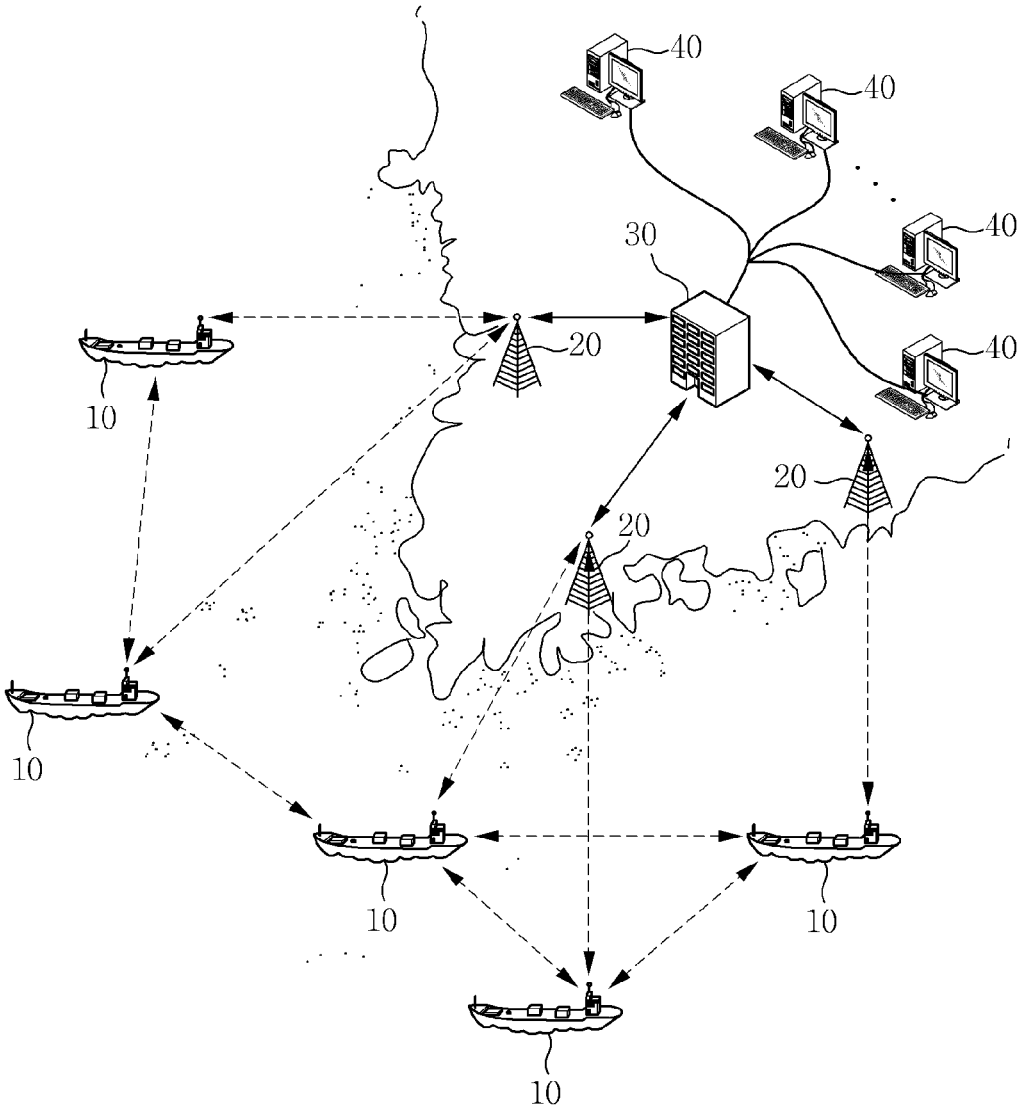
FIG. 1(PRIOR ART)
FIG. 1 is a diagram showing an example of the network configuration of AIS for merchant ships defined by the International Maritime Organization (IMO)

Hereinafter, the present invention will be described in detail with reference to the attached drawings. If in the specification, detailed descriptions of well-known functions or configurations may unnecessarily make the gist of the present invention obscure, the detailed descriptions will be omitted. The embodiments of the present invention are provided to more completely describe the present invention to those skilled in the art. Therefore, the shapes and sizes of components in the drawings may be exaggerated for clearer descriptions.

Figure 2:
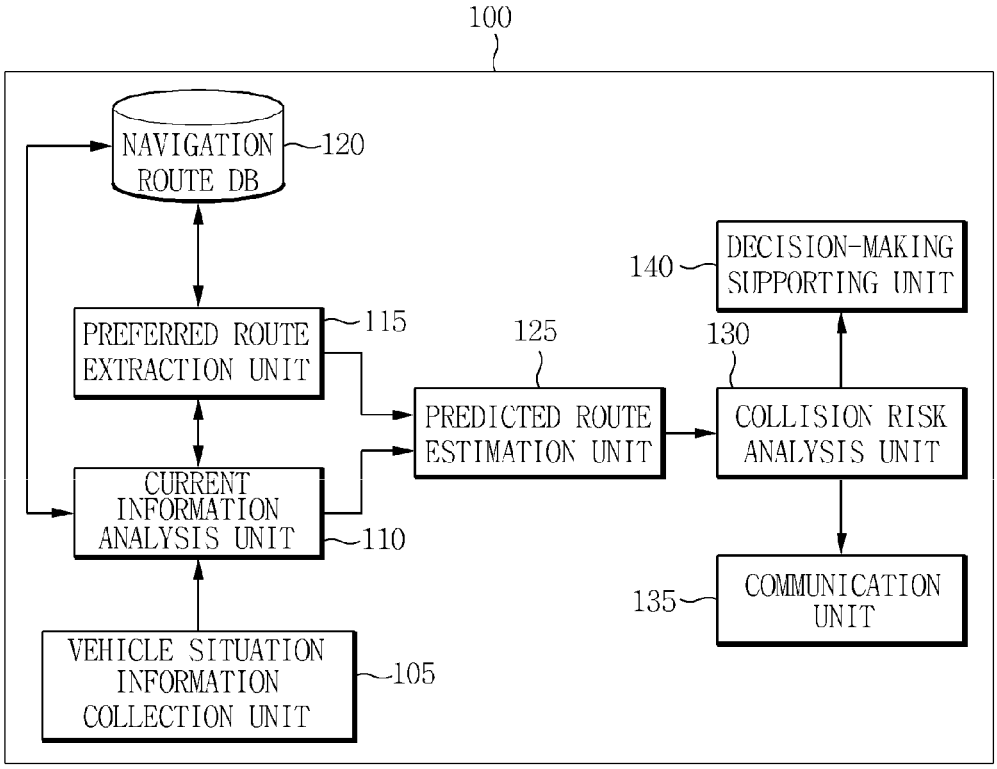
FIG. 2 is a block diagram showing in detail a traffic control apparatus according to the present invention.

FIG. 2 is a block diagram showing in detail a traffic control apparatus according to an embodiment of the present invention.

Referring to FIG. 2, a traffic control apparatus 100 according to the present invention includes a vehicle situation information collection unit 105, a current information analysis unit 110, a preferred route extraction unit 115, a navigation route database (DB) 120, a predicted route estimation unit 125, a collision risk analysis unit 130, a communication unit 135, and a decision-making supporting unit 140.

First, the vehicle situation information collection unit 105 collects information about the current navigational situations of a vehicle that is navigating. Here, the navigational situation information may include all of the information about the vehicle that is navigating and the surrounding situation information related to the vehicle.

For example, the navigational situation information may include the identification information of the vehicle (for example, the name of the vehicle), the identification information of a navigator who is controlling the vehicle, the current location information of the vehicle, the meteorological condition information about a place where the vehicle is located, and the starting point and destination information of the vehicle. In this case, the meteorological condition information may include information about the weather, wind direction, wind velocity, wave height, and rainfall of the place where the vehicle is located.

Meanwhile, the vehicle may be either a ship or an airplane. Hereinafter, a description will be made on the assumption that the vehicle is a ship, for the sake of facilitating the understanding of the present invention.

The vehicle information collection unit 105 may collect the navigational situation information of a relevant ship using an Automatic Identification System (AIS) provided on the ship. As described above, the AIS provided on the ship transmits various types of information such as the current location, course, speed, and state of the ship, which are measured by a Global Positioning System (GPS), and other types of information, to a control center. In this case, the AIS also transmits the navigational situation information of the relevant ship to adjacent ships, thus enabling all ships navigating on the sea to mutually ascertain the navigational state of other ships.

Further, the vehicle information collection unit 105 can also ascertain the location of a specific ship by using radar rather than the AIS.

The current information analysis unit 110 receives the current navigational situation information of the ship from the vehicle information collection unit 105, analyzes the type of ship, the current navigational situation (travel direction, travel pattern, etc.) of the ship, the navigator of the ship, the current meteorological conditions, etc., and also analyzes the travel pattern of the ship, thus determining whether the ship is navigating along a normal route. Further, the current information analysis unit 110 stores the navigation routes of the ship for respective navigational situations in the navigation route DB 120 on the basis of the results of the analysis.

For example, when ship B controlled by navigator A navigates the same section along different navigation routes in the respective cases where the wave height is 1 m and 2 m, the current information analysis unit 110 stores wave height information, ship identification information, and navigator identification information corresponding to each route in the navigation route DB 120 with this information matching corresponding routes.

On the assumption that a starting point and a destination in a current navigation are identical to those in a previous navigation, when the navigation routes (maritime routes) of a specific ship navigated by a specific navigator are analyzed for several months, predetermined uniform maritime routes are formed between the starting point and the destination.

Figure 3:
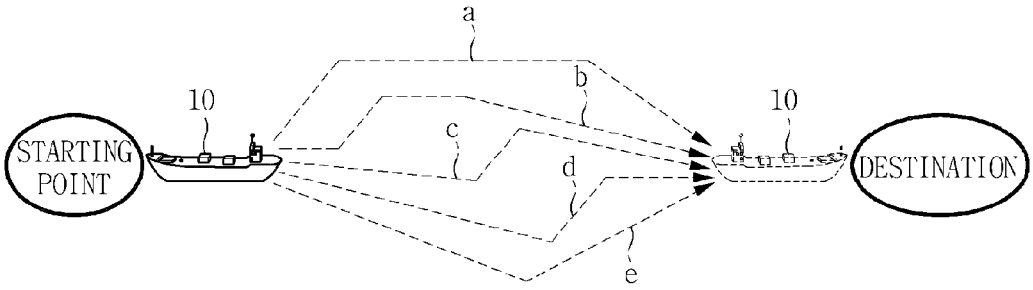
FIGS. 3 and 4 are diagrams showing a traffic control method according to the present invention.

In particular, the navigation routes of cargo boats and oil tankers which are traveling at home and abroad are almost the same for each navigator. The reason for this is that respective navigators have their preferred routes. A navigator of each ship 10 departing from the starting point and heading for the designation takes a different maritime route (refer to FIG. 3).

For example, if it is assumed that there are five navigable maritime routes (route a to route e) between the starting point and the destination, and the navigation times and navigation costs are identical for respective maritime routes, a certain navigator may prefer route a, whereas another navigator may prefer route d.

Since most navigators establish their maritime routes based on their experience, and navigate ships along the established maritime routes, different maritime routes are generally formed depending on the preferences of navigators until the ships arrive at the destination even if the ships depart from the same starting point.

Meanwhile, even if the starting points and destinations are always identical for individual routes, the maritime routes of the ship being navigated by a specific navigator are not always the same. The reason for this is that there are variables such as maritime meteorological conditions, so that the navigator changes his or her preferred previous maritime route to another route depending on variations in meteorological conditions, and then navigates the ship along the changed route.

However, although the navigator must change his or her preferred maritime route due to variations in environmental conditions (maritime meteorological conditions) in a specific section while navigating the ship along the preferred maritime route, the navigator selects another preferred route (another maritime route along which the specific section can be bypassed) on the basis of the previous data or previous experience, and then navigates the ship along the route.

That is, in the case of a ship which repeatedly navigates a certain section, the maritime routes of the ship are shown to be patterned depending on the type of ship, the navigator who is navigating the ship, meteorological conditions, etc.

Therefore, when the maritime routes of a specific ship for respective navigational situations collected for a predetermined period of time are analyzed, and are arranged into a database, it is possible to estimate the predicted navigation route of a relevant ship according to navigational situation information collected from the ship that is currently navigating (for example, a ship identification number, a navigator identification number, meteorological condition information, etc.).

The preferred route extraction unit 115 analyzes the degree of correlation between the current navigational situation information of the specific vehicle, which has been collected by the vehicle situation information collection unit 105, and navigation routes for respective navigational situations, which are stored in the navigation route DB 120, and extracts a preferred navigation route from the navigation route DB 120 based on the results of the analysis.

In detail, the preferred route extraction unit 115 primarily selects navigation routes corresponding to navigational situation information from the navigation route DB 120 using the identification information, navigator identification information, starting point and destination information, etc. of a specific ship, which are included in the navigational situation information, and finally extracts any one navigation route from the selected navigation routes by additionally taking into consideration the meteorological conditions of the sea.

The navigation route DB 120 stores the navigation routes of the ship for respective navigational situations.

The predicted route estimation unit 125 estimates the predicted navigation route of a relevant vehicle with reference to the traveling state (for example, travel direction, travel speed, travel pattern, etc.) of the vehicle on the basis of the preferred navigation route extracted by the preferred route extraction unit 115, and transfers the predicted navigation route to the collision risk analysis unit 130.

In this case, the predicted route estimation unit 125 estimates predicted navigation routes of a plurality of target ships, rather than a single target ship, and transfers the estimated predicted navigation routes to the collision risk analysis unit 130.

The collision risk analysis unit 130 compares the predicted navigation route of a specific ship with the predicted navigation routes of ships adjacent to the specific ship, and thus calculates the risks of collisions between those ships.

Figure 4:
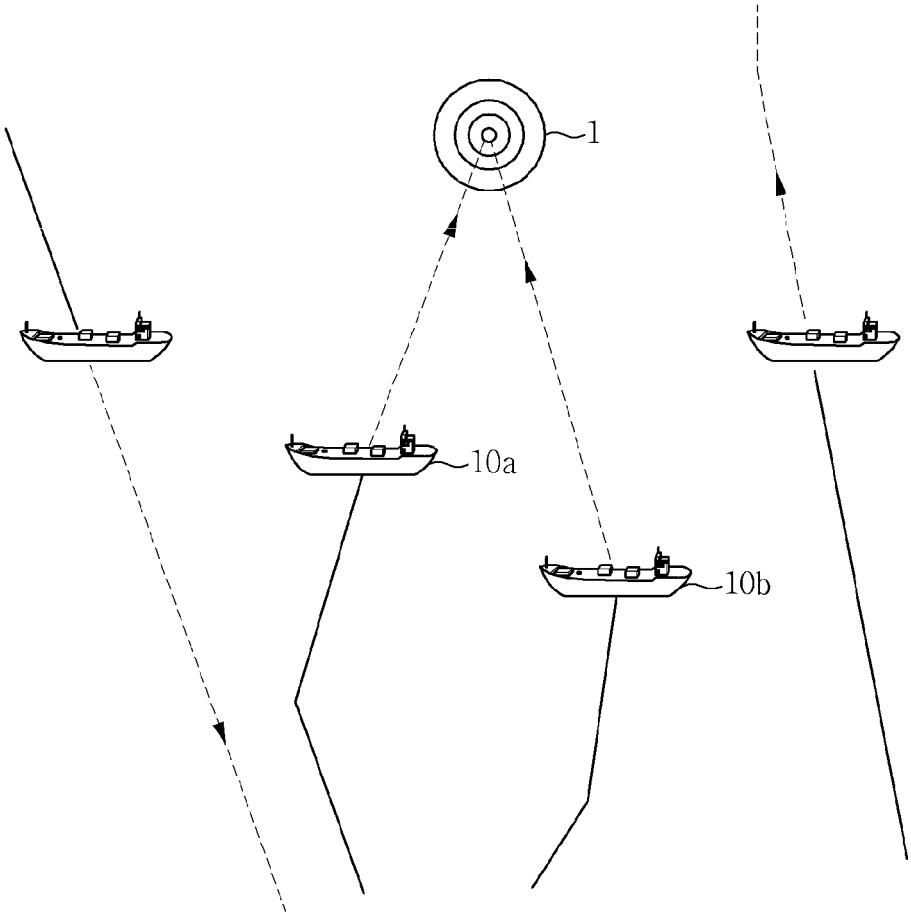

Referring to FIG. 4, solid lines denote routes along which ships have navigated, and dotted lines denote the predicted navigation routes of the ships.

When information about the predicted navigation routes, travel speeds, current locations, navigation patterns, etc. of a first ship 10*a* and a second ship 10*b* is known, the risk of a collision between the first ship 10*a* and the second ship 10*b* can be calculated.

As described above, the above information can be acquired by the vehicle situation information collection unit 105 and the predicted route estimation unit 125. As a probability that the two ships 10*a* and 10*b* will be located adjacent to the center of concentric circles, denoted by reference numeral '1' of FIG. 4, becomes high, the risk of a collision increases.

Further, the collision risk analysis unit 130 determines whether the calculated collision risk exceeds a preset threshold, and enables information, for warning the risk of a collision between ships, to be visually or auditorily output via the decision-making supporting unit 140 if it is determined that the collision risk exceeds the threshold.

Here, the information for warning the risk of a collision may include the identification information of ships for which there is a probability of a collision, the identification information of navigators of relevant ships, information about the distance between the ships, the location information of the ships, the predicted time of the collision between ships, etc.

Further, the collision risk analysis unit 130 performs processing such that the information for warning the risk of a collision can also be automatically transmitted to relevant ships through the communication unit 135.

As described above, the present invention allows a controller to anticipate a collision between ships on the basis of the warning output from the decision-making supporting unit 140, and enables the relevant ships to be effectively controlled.

However, when a large number of ships are present in a predetermined maritime area, and the risk of collisions between ships is simultaneously sensed, the controller may not effectively control all the ships and cope with such a risk.

Therefore, the present invention automatically notifies the relevant ships of the risk of a collision while informing the controller of the risk of the collision using the decision-making supporting unit 140, thus allowing the ships to prepare for and prevent a collision in advance for themselves.

The communication unit 135 transmits the information for warning the risk of a collision between ships to the relevant ships under the control of the collision risk analysis unit 130.

The information that is transmitted to the relevant ships may include information about the distance to the adjacent ship with which a relevant ship has the probability of a collision, the navigation route information, the location information, the identification information, and the navigator information of the adjacent ship, etc.

The decision-making supporting unit 140 visually or auditorily outputs the information for warning the risk of a collision between ships by using a speaker or a display means under the control of the collision risk analysis unit 130.

That is, the decision-making supporting unit 140 auditorily or visually supports the decision-making of the controller who is controlling the ships that are navigating.

Figure 5:
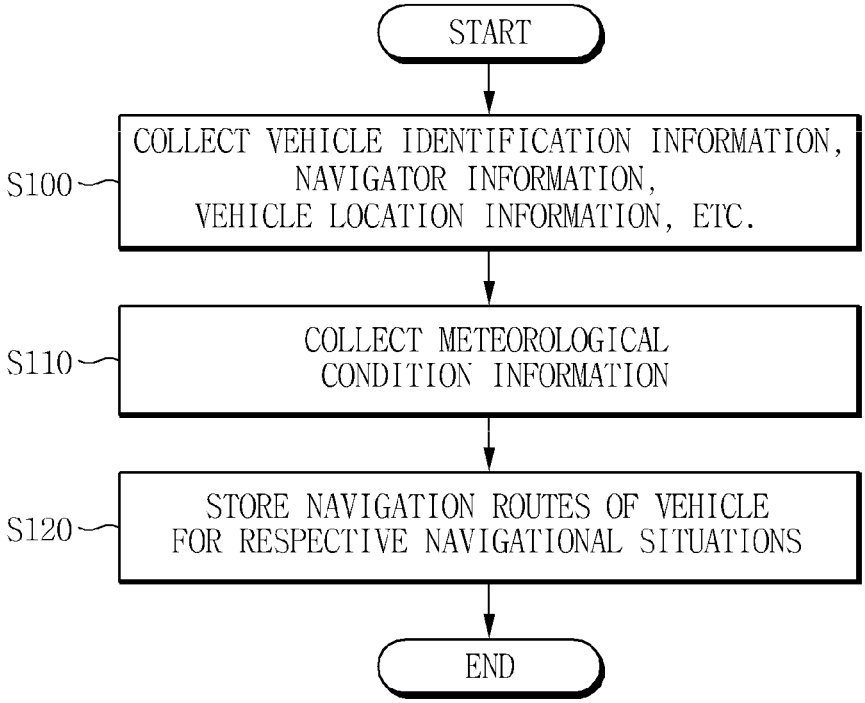
FIG. 5 is a flowchart showing a process in which the traffic control apparatus of the present invention stores navigational situation information with the navigational situation information matching the navigation routes of a vehicle.

FIG. 5 is a flowchart showing a process in which the traffic control apparatus of the present invention stores the navigational situation information with the navigational situation information matching the navigation routes of a relevant vehicle.

Referring to FIG. 5, the traffic control apparatus of the present invention collects the identification information, navigator information, starting point and destination information, current location information, etc. of a specific vehicle which is navigating at step S100. In this case, the vehicle may be either a ship or an airplane. In the case of the ship, the above information can be collected by an AIS provided on the ship.

Next, the traffic control apparatus collects in real time meteorological condition information about the area in which the vehicle is located at step S110.

Here, the meteorological condition information may be provided by the server of the external Meteorological Administration (not shown).

Further, the traffic control apparatus stores the information collected at steps S100 and S110 with the collected information matching the navigation routes of the vehicle at step S120. That is, the navigational routes for respective navigational situations are stored in the navigation route DB.

Figure 6:
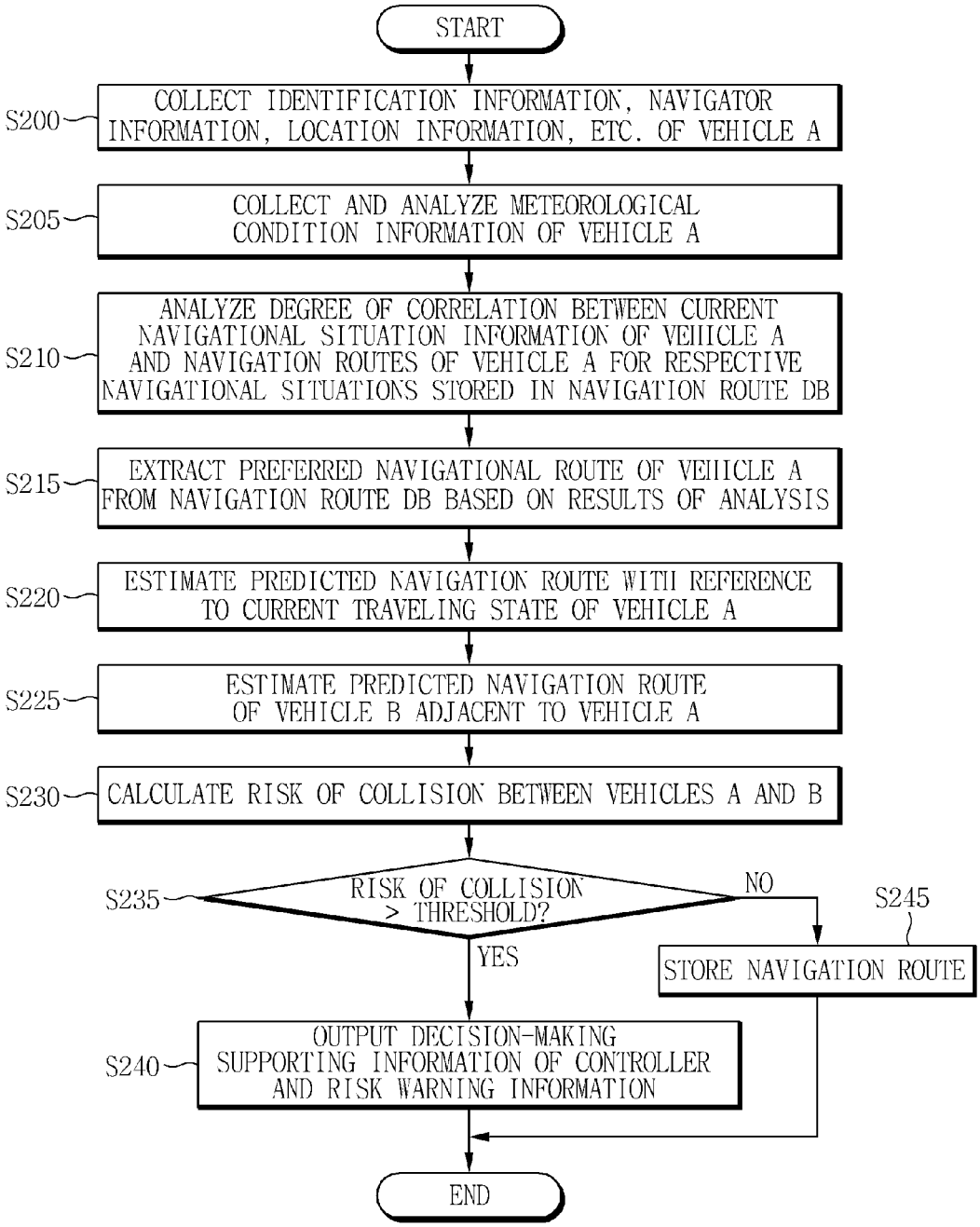
FIG. 6 is a flowchart showing a process in which the traffic control apparatus of the present invention estimates a predicted navigation route of a vehicle and performs traffic control based on the estimated predicted navigation route.

FIG. 6 is a flowchart showing a process in which the traffic control apparatus of the present invention estimates a predicted navigation route of a vehicle and performs traffic control based on the estimated predicted navigation route.

Referring to FIG. 6, the vehicle situation information collection unit of the present invention collects the vehicle identification information, navigator information, current location information, etc. of vehicle A that is currently navigating, by using the AIS, in real time at step S200. Further, the vehicle situation information collection unit collects meteorological condition information about the area in which the vehicle A is located at step S205.

The information collected at steps S200 and S205 is transferred to the current information analysis unit. The current information analysis unit analyzes the current navigational situations of the vehicle A based on the transferred information, and thereafter transfers the results of the analysis (current navigational situation information) to the preferred route extraction unit.

Then, the preferred route extraction unit analyses the degree of correlation between the current navigational situation information of the vehicle A, which is received from the current information analysis unit, and the navigation routes for navigational situations, which are stored in the navigation route DB, at step S210. Thereafter, the preferred route extraction unit extracts a preferred navigation route from the navigation route DB on the basis of the results of the analysis at step S215.

In more detail, the preferred route extraction unit primarily selects navigation routes corresponding to the navigational situation information from the navigation route DB using the identification information, navigator identification information, starting point and destination information, etc. of the vehicle A, which are included in the navigational situation information, and finally extracts any one navigation route from the selected navigation routes by additionally taking into consideration the meteorological conditions of the sea on which the vehicle A is located.

After the preferred navigation route has been extracted at step S215, the predicted route estimation unit finally estimates the predicted navigation route of the vehicle A with reference to the traveling state of the vehicle A (for example, travel direction, travel speed, travel pattern, etc.) on the basis of the preferred navigation route at step S220, and transfers the estimated predicted navigation route to the collision risk analysis unit.

Next, the collision risk analysis unit compares the predicted navigation route of a vehicle B adjacent to the vehicle A with the predicted navigation route of the vehicle A, and calculates the risk of a collision between the vehicle A and the vehicle B at step S230.

Since those skilled in the art will easily infer that the predicted navigation route of the vehicle B can be estimated using the above-described steps S200 to S220 at step S225, a repeated description thereof will be omitted here. In this way, the present invention estimates the predicted navigation routes of a plurality of target ships rather than a single target ship, and transfers the estimated predicted navigation routes to the collision risk analysis unit.

Next, the collision risk analysis unit determines whether the risk of a collision between the vehicle A and the vehicle B, calculated at step S230, exceeds a preset threshold at step S235.

If it is determined at step S235 that the risk of the collision between the vehicle A and the vehicle B exceeds the threshold, the collision risk analysis unit performs processing such that information for warning the risk of the collision between the ships can be visually or auditorily output by the decision-making supporting unit at step S240. Here, the information for warning the risk of the collision may include the identification information and navigator identification information of the vehicles A and B, information about the distance between the vehicles A and B, the location information of the vehicles A and B, the predicted time of the collision between the vehicles A and B, etc.

Further, at step S240, the collision risk analysis unit enables the information for warning the risk of the collision between the vehicles A and B to be individually transmitted to the vehicles A and B through the communication unit.

When a large number of ships are present in a predetermined maritime area, and the risk of collisions between ships is simultaneously sensed, the controller may not effectively control all the ships and cope with such a risk.

Therefore, the present invention automatically notifies the relevant ships of the risk of a collision while informing the controller of the risk of the collision using the decision-making supporting unit, thus allowing the ships to prepare for and prevent a collision in advance for themselves.

Meanwhile, if it is determined at step S235 that the risk of the collision between the vehicles A and B does not exceed the threshold, a navigation route corresponding to the current navigational situation information is stored in the navigation route DB at step S245. In this case, step S245 is not only performed in the above case, but also continuously performed while the vehicle is navigating.

As described above, it is apparent that the traffic control method of the present invention does not simply estimate a predicted navigation route using only existing navigation routes corresponding to the identification information or the navigator identification information of the vehicle, and does not simply calculate the risk of a collision between vehicles in consideration of only a current navigational situation.

That is, since the traffic control method of the present invention estimates a predicted navigation route of a specific vehicle by collectively considering the vehicle identification information, navigator information, meteorological condition information, etc. of the specific vehicle, it is possible to more precisely estimate the predicted navigation route. Further, the traffic control method can more accurately predict the risk of a collision between ships on the basis of the predicted route estimated in this way.

Meanwhile, the traffic control apparatus and method according to the present invention can be effectively applied to vehicles such as ships or airplanes, but the fields of application of the present invention are not limited thereto.

It is apparent that the present invention can also be used in technology for controlling vehicles traveling on an expressway of the ground by analyzing the relationships between travel routes, vehicle information, driver information, and travel situation information.

According to the present invention, a controller can more precisely and effectively perform control traffic using estimated predicted navigation routes of ships.

Further, the present invention is advantageous in that it automatically predicts a possible accident scenario using estimated predicted navigation routes and notifies a controller of the possible accident scenario in advance, thus preventing the occurrence of the collision between ships, and also preventing secondary damage (environmental pollution such as an oil spill) that may occur due to the collision between ships.

According to the present invention, the following advantages can be predicted.

The present invention estimates the navigation routes of ships that are navigating and provides the navigation routes to a controller, thus allowing the controller to more precisely and effectively perform traffic control on the basis of the estimated navigation routes.

Further, the present invention is advantageous in that it automatically predicts a possible accident scenario using estimated navigation routes and notifies a controller of the possible accident scenario in advance, thus preventing the occurrence of the collision between ships. Furthermore, the present invention can also prevent secondary damage (environmental pollution such as an oil spill) that may occur due to the collision between ships.

As described above, optimal embodiments have been disclosed with reference to the drawings and the specification. In this case, although specific terms have been used, they are used only to describe the present invention and are not used to restrict the meanings of the terms or limit the scope of the present invention described in the accompanying claims. Therefore, those skilled in the art will appreciate that various modifications, additions and substitutions are to possible. Therefore, the scope of the present invention should be defined by the spirit of the claims.

What is claimed is:

1. A maritime traffic control apparatus, comprising:

a navigation route database (DB) configured to store a plurality of preferred navigation routes between a starting point and a destination for a specific combination of a navigator and a maritime vehicle for a plurality of different navigational situations, wherein the preferred navigation routes are determined based on navigation routes traveled by the specific combination of the navigator and the maritime vehicle over a plurality of months;

a vehicle situation information collection unit configured to collect current navigational situation information of the maritime vehicle;

a preferred route extraction unit configured to extract one of the plurality of preferred navigation routes for the specific combination of the navigator and the maritime vehicle for a navigational situation, wherein the preferred route extraction unit is configured to analyze the degree of correlation between the navigational situation and the plurality of preferred navigation routes and to extract a preferred navigation route based on the analysis and a meteorological condition information;

a predicted route estimation unit configured to estimate a predicted navigation route of the maritime vehicle based on an extracted preferred navigation route with reference to a travel direction, a travel speed, or a travel pattern of the maritime vehicle; and a current information analysis unit for storing navigation routes of the maritime vehicle for respective navigational situations in the navigation route DB, based on the current navigational situation information collected by the vehicle situation information collection unit.

2. The maritime traffic control apparatus of claim 1, further comprising a collision risk analysis unit for comparing the predicted navigation route with a predicted navigation route of an adjacent maritime vehicle adjacent to the maritime vehicle to calculate a risk of a collision between the maritime vehicle and the adjacent maritime vehicle, and performing processing for providing information for warning the risk of the collision between the maritime vehicle and the adjacent maritime vehicle, if the risk of the collision exceeds a threshold.

3. The maritime traffic control apparatus of claim 1, wherein the navigational situation information comprises identification information, navigator information, and location information of the maritime vehicle, meteorological condition information about a place where the maritime vehicle is located, and starting point and destination information of the maritime vehicle.

4. The maritime traffic control apparatus of claim 3, wherein the meteorological condition information comprises information about at least one of weather, wind direction, wind velocity, wave height, and rainfall of the place where the maritime vehicle is located.

5. The maritime traffic control apparatus of claim 2, further comprising a communication unit for receiving information for warning the risk of a collision between the maritime vehicle and the adjacent maritime vehicle from the collision risk analysis unit and transmitting the received information to relevant maritime vehicles.

6. The maritime traffic control apparatus of claim 2, further comprising a decision-making supporting unit for receiving information for warning the risk of a collision between the maritime vehicle and the adjacent maritime vehicle from the collision risk analysis unit so as to support decision-making of a controller who is controlling the maritime vehicle, and auditorily or visually outputting the received information.

7. The maritime traffic control apparatus of claim 1, wherein the vehicle is a ship.

8. The maritime traffic control apparatus of claim 7, wherein the vehicle information collection unit collects the navigational situation information using an Automatic Identification System (AIS) provided on the ship.

9. A maritime traffic control method, comprising:

collecting current navigational situation information of a maritime vehicle that is navigating;

extracting a preferred navigation route of the maritime vehicle corresponding to the collected current navigational situation information from a navigation route database (DB) which stores a plurality of preferred navigation routes between a starting point and a destination for a specific combination of a navigator and the maritime vehicle for a plurality of different navigational situations, wherein the preferred navigation routes are determined based on navigation routes traveled by the specific combination of the navigator and the maritime vehicle over a plurality of months, and wherein the preferred navigation route is extracted based on an analysis of the degree of correlation between the navigational situation and the plurality of preferred navigation routes in the database, wherein the estimated predicted navigation route is based on the result of the analysis and a meterological condition information;

estimating a predicted navigation route of the specific combination of the navigator and the maritime vehicle based on an extracted preferred navigation route with reference to a travel direction, a travel speed, or a travel pattern of the maritime vehicle; and storing the navigation routes of the maritime vehicle for respective navigational situations in the navigation route DB based on the collected current navigational situation information.

10. The maritime traffic control method of claim 9, further comprising:

comparing the predicted navigation route with a predicted navigation route of a maritime vehicle adjacent to the maritime vehicle to calculate a risk of a collision between the maritime vehicle and the adjacent maritime vehicle;

determining whether the risk of the collision exceeds a threshold; and performing processing for providing information for warning the risk of the collision between the maritime vehicle and the adjacent maritime vehicle, if it is determined that the risk of the collision exceeds the threshold.

11. The maritime traffic control method of claim 10, wherein the performing processing for providing information for warning the risk of the collision between the maritime vehicle and the adjacent maritime vehicle is configured such that the information for warning the risk of the collision between the maritime vehicle and the adjacent maritime vehicle is auditorily or visually output so as to support decision-making of a controller who is controlling the maritime vehicle.

12. The maritime traffic control method of claim 9, wherein the navigational situation information comprises identification information, navigator information, and location information of the maritime vehicle, meteorological condition information about a place where the maritime vehicle is located, and starting point and destination information of the maritime vehicle.

13. The maritime traffic control method of claim 12, wherein the meteorological condition information comprises information about one or more of weather, wind direction, wind velocity, wave height, and rainfall of the place where the maritime vehicle is located.

14. The maritime traffic control method of claim 9, further comprising transmitting the information for warning the risk of the collision between the maritime vehicle and the adjacent maritime vehicle to the relevant maritime vehicles.

15. The maritime traffic control method of claim 9, wherein the vehicle is a ship.

16. The maritime traffic control method of claim 15, wherein the collecting the current navigational situation information of the maritime vehicle that is navigating is configured such that the navigational situation information is collected using an Automatic Identification System (AIS) provided on the ship.

* * * * *